US007922046B2

(12) United States Patent
Radtke et al.

(10) Patent No.: US 7,922,046 B2
(45) **Date of Patent: *Apr. 12, 2011**

(54) BRASSIERE CLEANING AND STORAGE CONTAINER

(75) Inventors: Lauren J. Radtke, Dallas, TX (US); Michael J. DeMarco, Dallas, TX (US); Raymond M. Green, McKinney, TX (US)

(73) Assignee: Mainytime, Inc., Dallas, TX (US)

( * ) Notice: Subject to any disclaimer, the term of this patent is extended or adjusted under 35 U.S.C. 154(b) by 646 days.

This patent is subject to a terminal disclaimer.

(21) Appl. No.: 11/967,855

(22) Filed: Dec. 31, 2007

(65) Prior Publication Data

US 2008/0099518 A1 May 1, 2008

Related U.S. Application Data

(63) Continuation of application No. 11/222,716, filed on Sep. 9, 2005, now Pat. No. 7,350,679.

(51) Int. Cl.
*D06C 15/00* (2006.01)

(52) U.S. Cl. ..... 223/84; 223/66; 223/1

(58) Field of Classification Search ..... 223/84, 223/57, 66, 1; 450/41–55; 206/278, 292; 248/275; 269/237, 287, 901, 254 CS; 99/323
See application file for complete search history.

(56) References Cited

U.S. PATENT DOCUMENTS

| | | | | |
|---|---|---|---|---|
| 2,730,275 | A | 1/1956 | Flores | |
| 2,755,004 | A | 7/1956 | Schumacher | |
| 2,815,157 | A | 12/1957 | Badgley | |
| 2,951,621 | A | 9/1960 | Cheney | |
| 3,085,723 | A * | 4/1963 | Vanderburg | 223/66 |
| 3,738,549 | A | 6/1973 | Driscoll | |
| 4,998,616 | A | 3/1991 | Hillinger | |
| 5,074,410 | A | 12/1991 | Fries et al. | |
| 5,320,429 | A * | 6/1994 | Toyosawa | 383/117 |
| 5,556,013 | A | 9/1996 | Mayer | |
| 5,829,083 | A | 11/1998 | Sutton | |
| 5,971,236 | A * | 10/1999 | DesForges et al. | 223/84 |
| 6,234,368 | B1 | 5/2001 | DesForges et al. | |
| 6,471,102 | B2 | 10/2002 | Hancock | |
| 6,742,683 | B1 | 6/2004 | Phan | |
| 2006/0162397 | A1 * | 7/2006 | Ke | 68/235 R |

* cited by examiner

*Primary Examiner* — Shaun R Hurley
*Assistant Examiner* — Andrew W Sutton
(74) *Attorney, Agent, or Firm* — Gardere Wynne Sewell, LLP

(57) ABSTRACT

A container for supporting a brassiere or a similar garment for cleaning and storage includes opposed flat plate members connected by a hinge, and opposed container cup members connected to the respective plate members at hinge connections for folding the container cup members over the plate members and for folding the plate members with respect to each other to form a closed container for supporting a brassiere. The plate members include hinged support members, each having an arcuate cross shape, for supporting brassiere cups between the plate members and the container cup members. Spaced apart clips secure the brassiere straps to the plate members. Spaced apart latches releasably secure the cup members to the plate members and the plate members to each other for placing the container in a compact folded position.

9 Claims, 7 Drawing Sheets

BRASSIERE CLEANING AND STORAGE CONTAINER

CROSS REFERENCE TO RELATED APPLICATIONS

This is a continuation of U.S. patent application Ser. No. 11/222,716, filed Sep. 9, 2005, now U.S. Pat. No. 7,350,679, which is incorporated herein by reference.

BACKGROUND OF THE INVENTION

Brassieres and similar garments are commonly made with two cup-shaped members which may be formed of fabric which can be reinforced with foam padding and metal or plastic wire reinforcements. The cup-shaped members are interconnected by a short strap and each cup-shaped member is also connected to opposed backstraps which include fastening elements at their distal ends. The backstraps are also typically interconnected with the cup-shaped members by respective shoulder straps. Brassieres may be made of delicate fabrics, including lace, satin, silk and the like. Accordingly, washing brassieres can easily damage the fabric or other parts of the brassier structure.

Various attempts have been made to provide holders or containers for brassieres and similar garments for use during washing and storage. However, prior art devices have been somewhat complicated, difficult to fabricate and somewhat inconvenient to use and store. Accordingly, there has been a need for improvements in brassiere cleaning and storage devices and those improvements have been met by the present invention.

SUMMARY OF THE INVENTION

The present invention provides an improved cleaning and storage device or container for brassieres and similar garments. In particular, the brassiere cleaning and storage container is adapted to provide support for the brassiere cup-shaped members, the backstraps and the shoulder straps to hold all of these members in predetermined positions to facilitate cleaning, drying and storage without damage to or distortion of the garment.

In accordance with one aspect of the present invention, a brassiere cleaning and storage container is provided with hingedly interconnected generally planar plate members which are provided with an improved arrangement of spaced apart clips for supporting the brassiere backstraps and shoulder straps. Spaced apart support members for the brassiere cups are provided on the plate members and are moveable into and out of working positions to facilitate mounting the brassiere on the container. The container includes two outer cup members which are hingedly connected to the plate members and fold over the plate members to contain the cup members of the brassiere or similar garments in proper position to prevent distortion or damage to the garment.

In accordance with another aspect of the invention, the plate members and container cup members are operable to be secured to each other by spaced apart latches which are quickly and easily releasable to open the container for insertion or removal of the garment. Still further, the brassiere holder or container of the present invention is foldable into a compact condition and wherein opposed interconnected container cup and plate member assemblies may be latched to each other to provide ease of storage or transport.

In accordance with yet a further aspect of the present invention, a brassiere container or holder is provided which may be easily connected to a hanger and may be easily connected to additional brassiere holders or containers to facilitate drying of brassieres which have been laundered in the containers and for ease of storage of multiple containers.

Those skilled in the art will appreciate the above-mentioned aspects and superior features of the invention together with other advantages thereof upon reading the detailed description which follows in conjunction with the drawings.

DETAILED DESCRIPTION OF A PREFERRED EMBODIMENT

Figure 1:
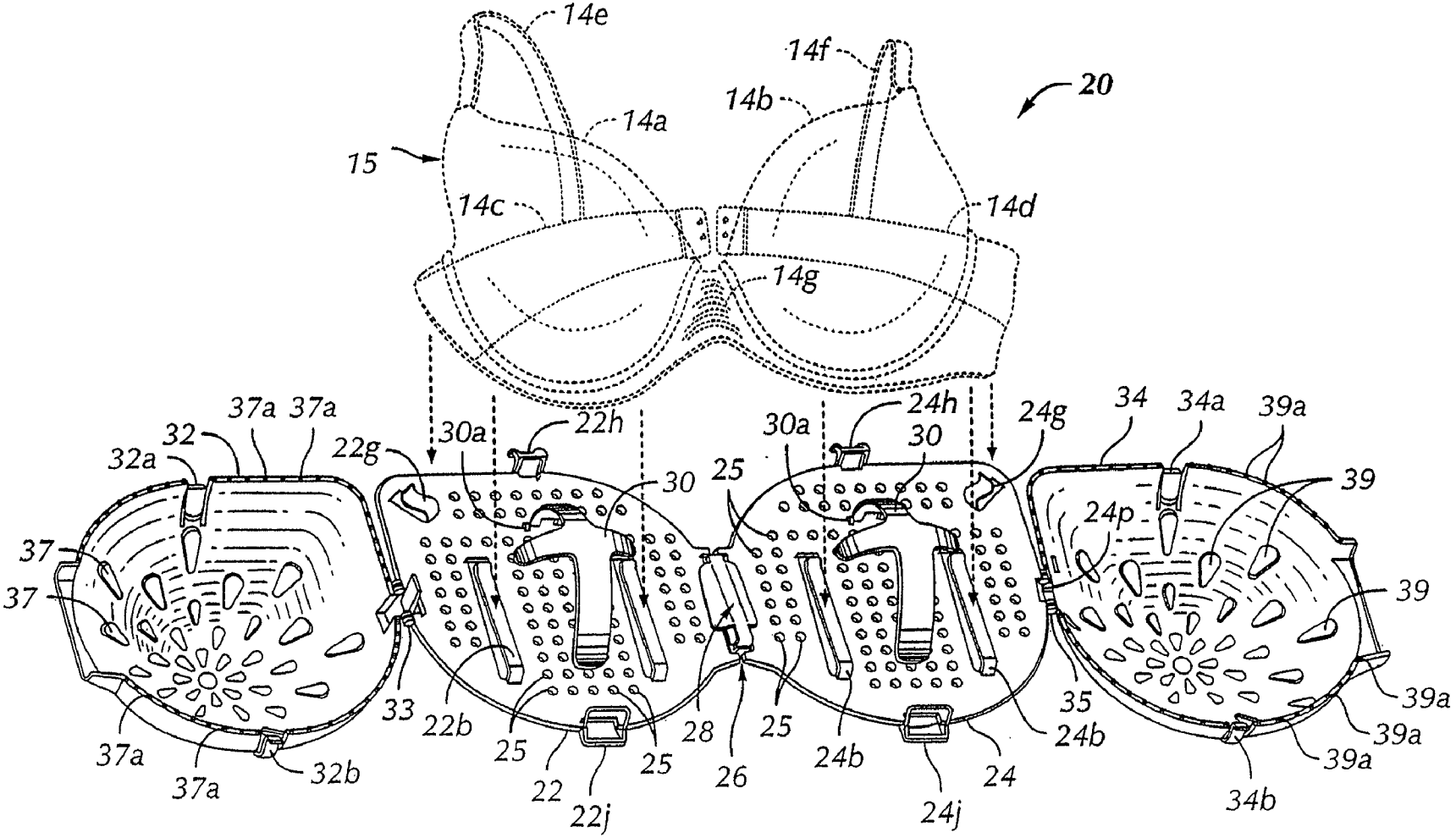
FIG. 1 is a perspective view of a brassiere cleaning and storage container or holder in accordance with the invention, shown in an open position.

In the description which follows like parts are marked throughout the specification and drawing with the same reference numerals, respectively. The drawing figures may not necessarily be the scale.

Referring to FIG. 1, there is illustrated a brassiere cleaning and storage container or holder in accordance with the invention and generally designated by the numeral 20. The container 20 is characterized by opposed generally flat or planar plate members 22 and 24, both of which are substantially foraminous as provided by rows of plural ventilation holes 25, respectively, as shown. The container plate members 22 and 24 are interconnected by an elongated hinge member 26, see FIGS. 7, 8 and 9 also. The plate members 22 and 24 are mirror image parts and are provided with elongated recesses adjacent one side thereof and indicated by the numerals 22*a* and 24*a*, respectively, FIG. 9. Spaced apart hinge pins 27*a* and

Figure 7:
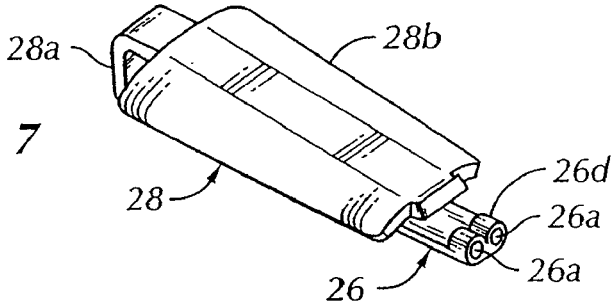
FIG. 7 is a perspective view of a combination hinge and clip member for connecting the two plate members of the brassiere container.
Figure 8:
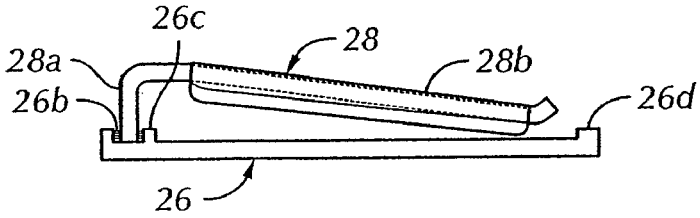
FIG. 8 is a side elevation of the combination clip and hinge member shown in FIG. 7.
Figure 9:
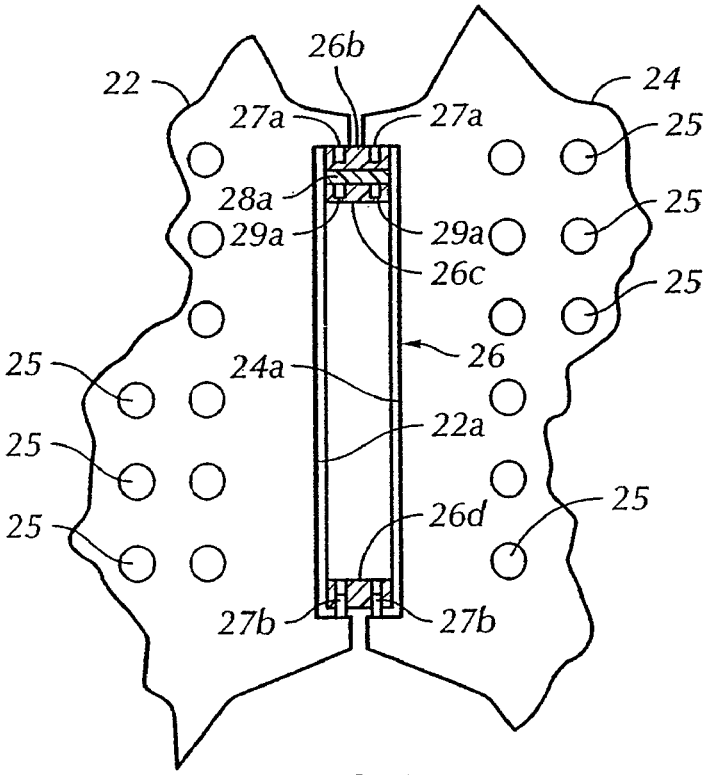
FIG. 9 is a detail view showing the hinge connection between the container plate members utilizing the hinge member shown in FIGS. 7 and 8.

27*b* are formed on the respective plate members 22 and 24, as shown in FIG. 9, and project into cooperating bores formed in the hinge member 26. Two of such bores are shown in FIG. 7, by way of example, and indicated by the numeral 26*a*. The hinge member 26 may be secured in a working position, as shown in FIG. 9, by flexing the hinge member to snap the hinge member into position with the hinge pin members 27*a* and 27*b* projecting into pin receiving bores 26*a* at opposite ends of the hinge member. The hinge member is provided with spaced apart bosses 26*b*, 26*c* and 26*d*, each of which has pairs of pin receiving bores 26*a* formed therein and spaced apart for receiving the hinge pins 27*a* and 27*b* and respective locating pins 29*a*, FIG. 9, for a clip member 28, see FIGS. 7 and 8. Clip member 28 has a base part 28*a* connected to pins 29*a* and a cantilever arm 28*b* which may be elastically deflected away from hinge member 26 to place a portion of a brassiere center strap, for example, thereunder.

Referring again to FIG. 1, the brassiere container 20 is further characterized by backstrap support clips 22*b* and 24*b* which are spaced apart, aligned with each other and are substantially parallel with each other as shown in FIG. 1. Support clips 22*b* and 24*b* are elastically deflectable and are located on the respective plate members 22 and 24 such that a cross-shaped arcuate brassiere cup support member 30 may be mounted on each of the plate members 22 and 24, as shown between the respective pairs of backstrap support clips 22*b* and 24*b*, respectively. The cup support members 30 are somewhat skeletal, cross-shaped members, and are shaped to be substantially arcuate, see FIG. 4 also. The support members 30 are hingedly connected to the respective plate members 22 and 24 at hinge points 30*a*, see FIG. 4 also, so that these members may be rotated about the hinge points to facilitate placing the brassiere backstraps under the clip members 22*b* and 24*b*. The cross-shaped arcuate support members 30 are thus adapted to be positioned so that they support the cup members 14*a* and 14*b* of a brassiere 15, FIG. 1, while allowing for substantial circulation of air to facilitate drying the brassiere cup members without permitting distortion or shrinkage of such members. Each of plate members 22 and 24 is provided with a suitable configuration of hinge bosses 22*f* and 24*f*, FIG. 4, to support the cup support members 30 for pivotal movement at the hinge connections 30*a*.

Referring again to FIG. 1, each of the plate members 22 and 24 is also provided with at least one shoulder strap support clip 22*g* and 24*g* as, shown, integrally formed on the respective plate members in a manner similar to the forming of the backstrap support clips 22*b* and 24*b* and located in a position to provide for slipping brassiere shoulder straps 14*e* and 14*f* under the clip members 22*g* and 24*g* to provide additional support and containment of these components of a conventional brassiere. Referring still further to FIG. 1, the container 20 is characterized by opposed outer brassiere cup support members comprising somewhat arcuate cup-shaped elements 32 and 34 which are substantially mirror image parts. Container cup members 32 and 34 are hingedly connected to the plate members 22 and 24 at respective hinges 33 and 35, as shown in FIG. 1. Accordingly, the container cup members 32 and 34 may be folded over the respective plate members 22 and 24 and latched thereto by latch mechanisms to be described in further detail herein. In fact, as shown in FIG. 1, each of the plate members 22 and 24 is provided with opposed latch bail members 22*h* and 22*j* and 24*h* and 24*j*, respectively.

Figure 2:
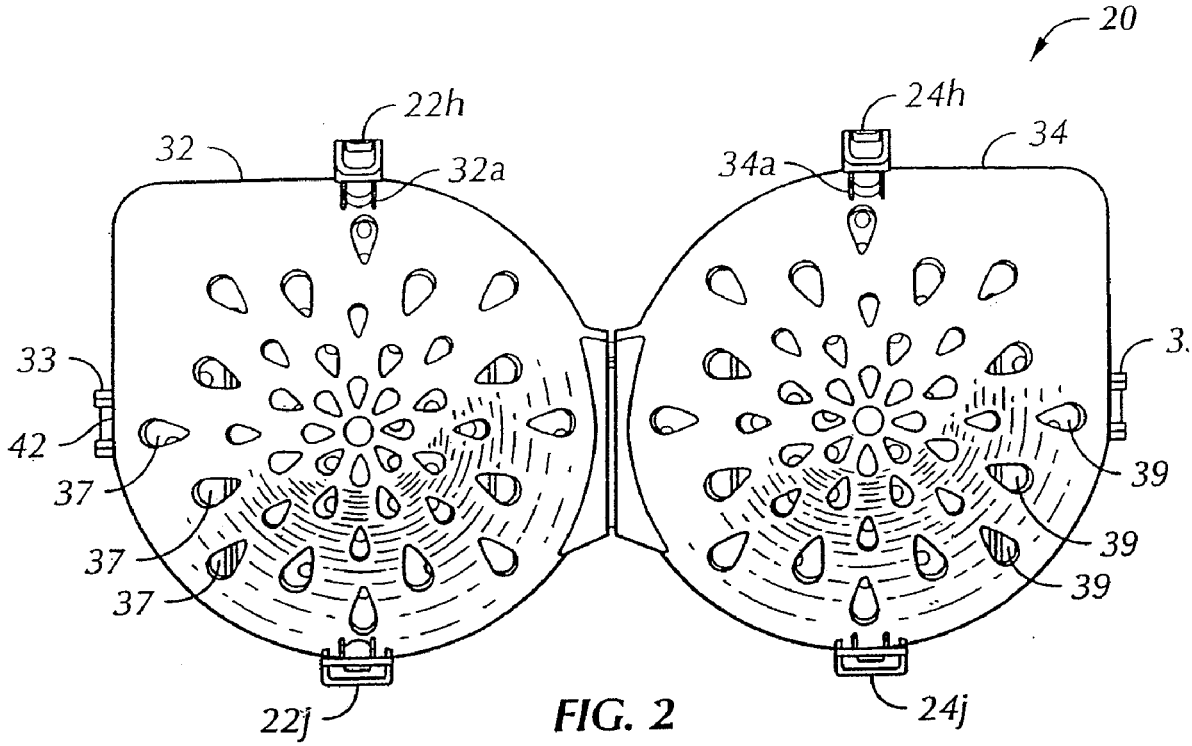
FIG. 2 is a front elevation of the brassiere container of the invention showing the cup members folded and latched to opposed plate members.
Figure 4:
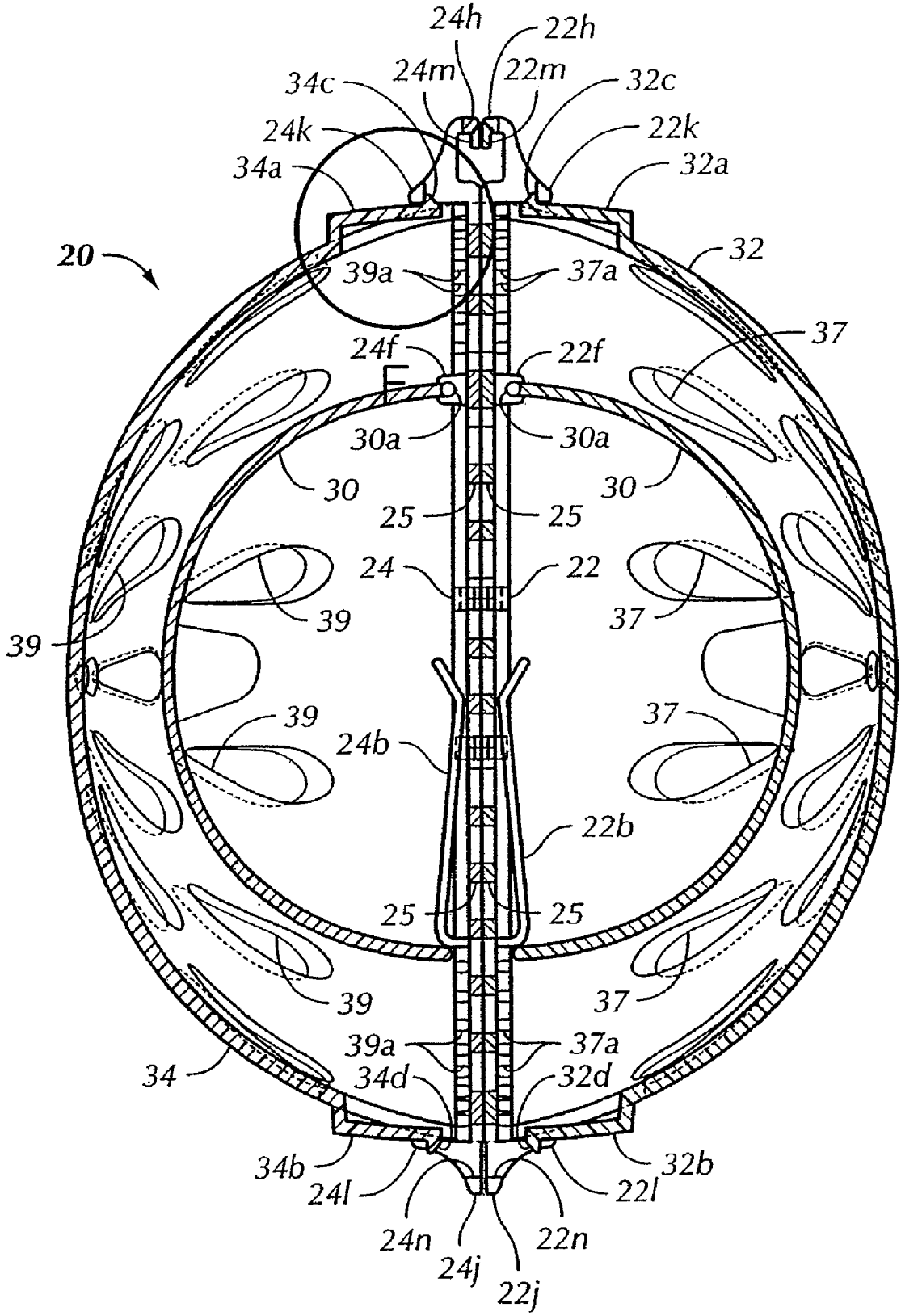
FIG. 4 is a section view taken generally along the line 4-4 of FIG. 3.

Accordingly, the respective container cup members 32 and 34 include cooperating latch members 32*a*, 32*b*, 34*a* and 34*b*, respectively, which cooperate with the bails 22*h*, 22*j*, 24*h*, 24*j* on the respective plate members 22 and 24 to latch the container cup members disposed over and aligned with the plate members 22 and 24, as shown in FIG. 2 and also FIG. 4. Cup members 32 and 34 are each provided with plural spaced apart openings 37 and 39, as shown in FIGS. 1, 2 and 4, to facilitate fluid, including air, circulation through the container 20. Still further, each of the cup members 32 and 34 is provided with spaced apart projections or standoffs 37*a* and 39*a* disposed about the perimeters of the respective cup members and engageable with the plate members 22 and 24 when the cup members are in their closed and working positions, see FIG. 4, to allow additional air circulation and drainage of water or other cleaning fluids out of the container 20.

Figure 6:
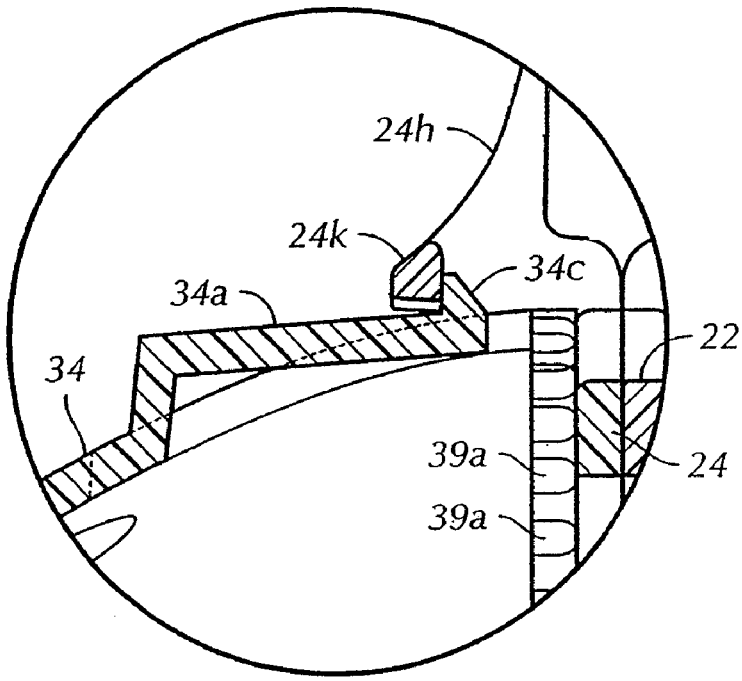
FIG. 6 is a detail view on a larger scale taken generally within the dashed circle of FIG. 4 and showing the features of one of the latch members between a container cup member and a plate member.
Figure 10:
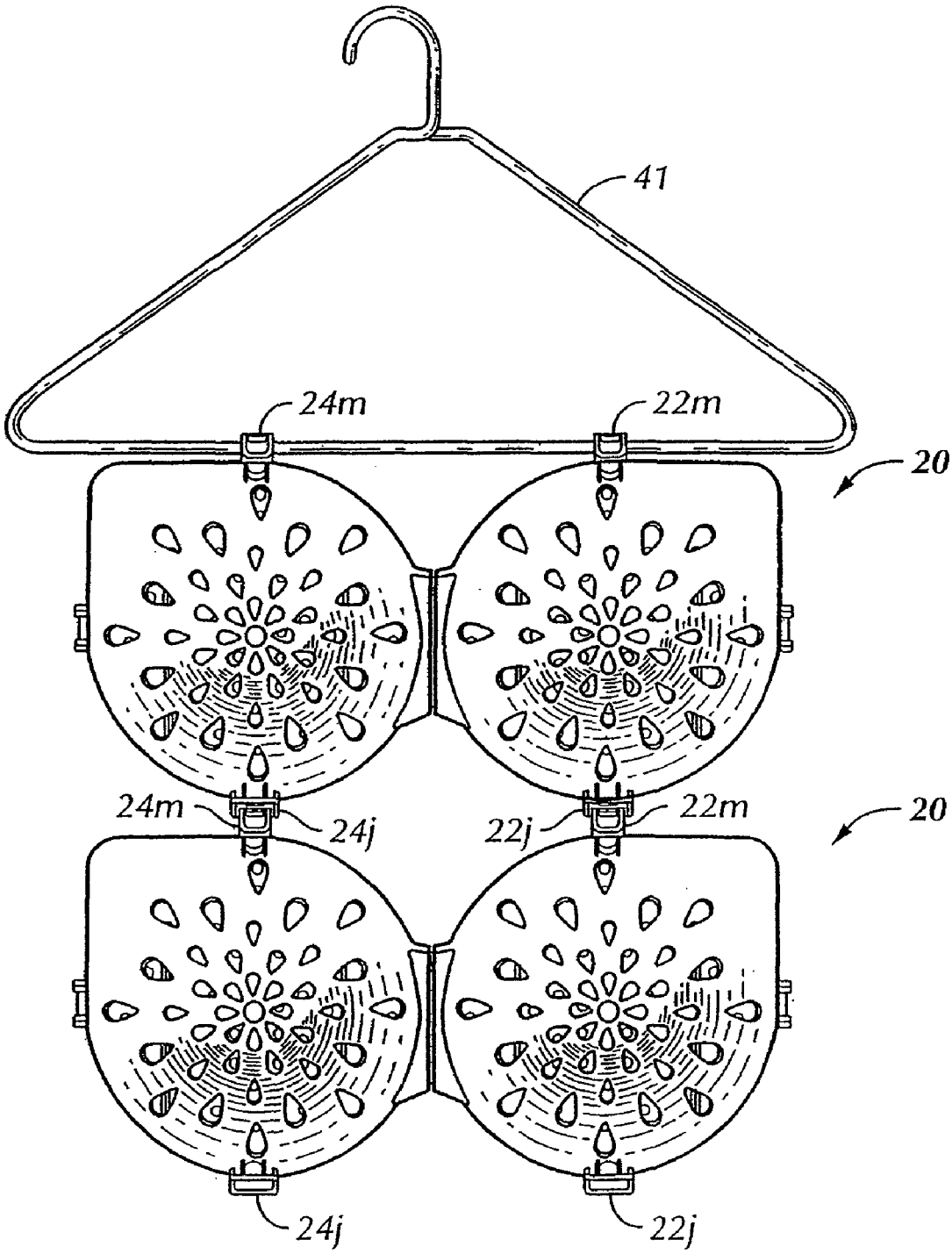
FIG. 10 is a front elevation illustrating how one or more of the brassiere containers of the invention may be hung for drying and/or storage.

Referring to FIG. 4, the respective latches 32*a* and 34*a* comprise cantilever elastically deflectable members provided with hook-shaped distal ends 32*c* and 34*c*, respectively, see FIG. 6 also by way of example, for engagement with respective portion 22*k* and 24*k* of the bails 22*h* and 24*h*. Still further, each of the bails 22*h* and 24*h* is provided with a distal hook portion 22*m* and 24*m*, see FIG. 4, for hanging the container 20 from a coat hanger or the like and/or for hanging one container from another, as shown in FIG. 10 and to be described further herein. In like manner, the cantilever elastically deflectable latches 32*b* and 34*b* include respective hook-shaped tip portions 32*d* and 34*d*, FIG. 4, which engage cross-members 221 and 241 of the bail members 22*j* and 24*j* to latch the cup members 32 and 34 in the positions shown in FIG. 4. Bail members 22*j* and 24*j* also include respective openings 22*n* and 24*n*, FIG. 4, whereby, for example, hook portions 22*m* and 24*m* of another container 20 may be hung below a container 20, as illustrated, for example, in FIG. 10 wherein one container 20 is suspended from a conventional coat hanger 41 by its bail hooks 22*m* and 24*m* and a container 20 below the container connected to coat hanger 41 is suspended by its hook portions 22*m* and 24*m* projecting through the openings 22*n* and 24*n* of the container suspended from the hanger.

Figure 3:
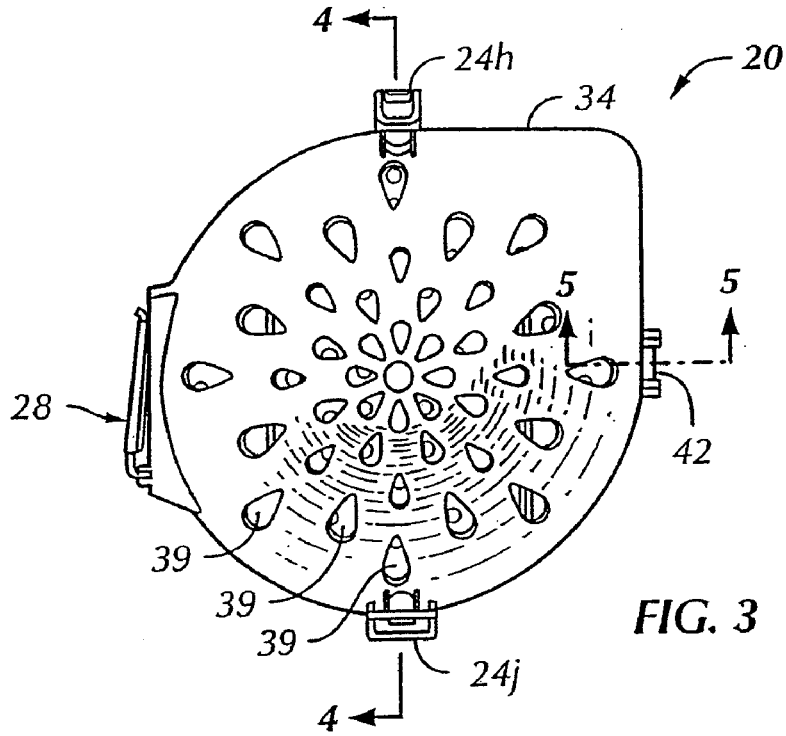
FIG. 3 is a front elevation of the container shown in FIG. 2 where the opposed plate and cup member assemblies are folded together to a container closed, storage or transport position.
Figure 5:
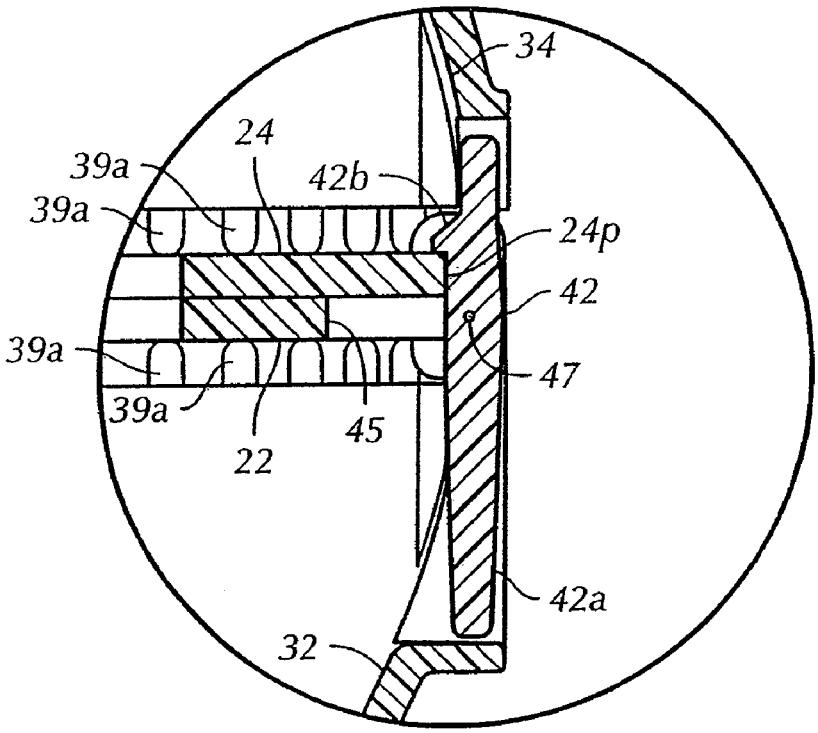
FIG. 5 is a detail section view taken generally along the line 5-5 of FIG. 3.

Referring again to FIG. 1, briefly, and also FIG. 5, the container 20 may be latched in a completely closed position, as shown also in FIG. 3, by a cantilever latch member 42 formed on plate member 22 and including an actuating handle portion 42*a* and a hook portion 42*b*, FIG. 5, operable to engage plate 24 at a suitable notch or recess on the periphery thereof and indicated by the reference numeral 24*p* in FIG. 5. Latch member 42 is integrally molded with plate member 22 and includes a clearance slot 45, FIG. 5, to facilitate allowing the latch member 42 to be elastically flexed by engagement of the handle part 42*a* to essentially rotate the latch member a very limited amount generally about an axis 47, FIG. 5. In this way, the container 20 may be latched in a completely closed storage or transport position, as shown in FIG. 3. Alternatively, the container 20 may be allowed to remain in a position shown in FIG. 2 for transport or storage or for hanging one or more containers, as shown in FIG. 10. For placement of the container 20 in a cleaning apparatus such as a conventional clothes washer and/or dryer, typically, the container is latched completely closed in the position shown in FIGS. 3, 4 and 5.

Referring again briefly to FIG. 1, the container 20 is operable to receive a brassiere, such as the brassiere 15 by opening the container to the position shown in FIG. 1. Preferably, brassiere 15 is supported on a container 20 by moving the cup support members 30 to an open position, generally upward viewing FIG. 1, to allow access to the clips 28, 22*b*, and 24*b* for placing the brassiere straps 14*g*, 14*c* and 14*d* under the clips, respectively, and to be retained thereby. The cup support members 30 may then be rotated back to the positions shown in FIG. 1 and the brassiere cup portions 14*a* and 14*b* placed thereover. Shoulder straps 14*e* and 14*f* may be placed under the clips 22*g* and 24*g* at this time. As mentioned above, placement of the brassiere 15 on the plate members 22 and 24 would also include, preferably, slipping the center strap portion 14*g* under the clip 28 as part of the process of mounting the brassiere on the container 20.

After the brassiere 15 is placed in the position described above. The container cup members 32 and 34 may be folded over the brassiere cup portions 14*a* and 14*b* to retain these portions between the support members 30 and the container cup members 32 and 34, respectively. The container cup members 32 and 34 are firmly latched in position as they are rotated about their respective hinges 33 and 35 into positions overlying the plate members 22 and 24. At this time the container 20 is closed to the extent that it supports the brassiere 15 and the container may be placed in storage by, for example, suspending the container from a hanger, such as shown in FIG. 10. Still further, the container 20 may be folded to a completely closed and latched position as shown in FIGS. 3 and 5. Of course, the container 20 may be opened to remove a brassiere therefrom by depressing the latch 42*a* to unlatch end plates 22 and 24 from each other and then by depressing the latch members 32*a*, 32*b*, 34*a*, and 34*b* to allow the container cup members 32 and 34 to be swung to the open position shown in FIG. 1 to allow removal of a brassier from the container.

Figure 11:
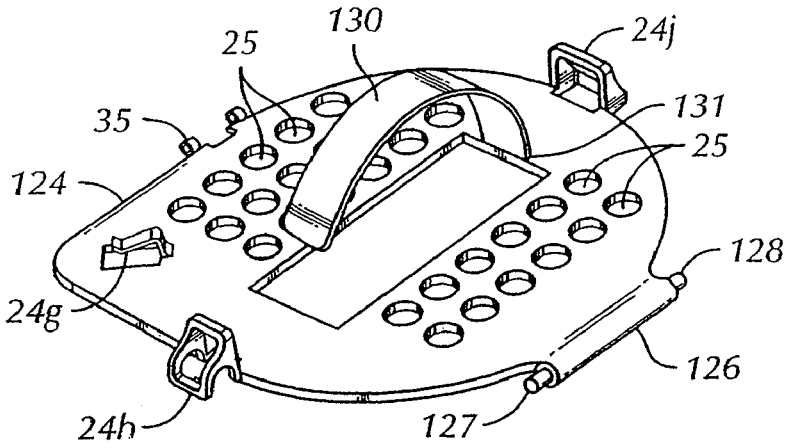
FIG. 11 is a perspective view of an alternate embodiment of a plate member for the brassiere cleaning and storage container in accordance with the invention.
Figure 12:
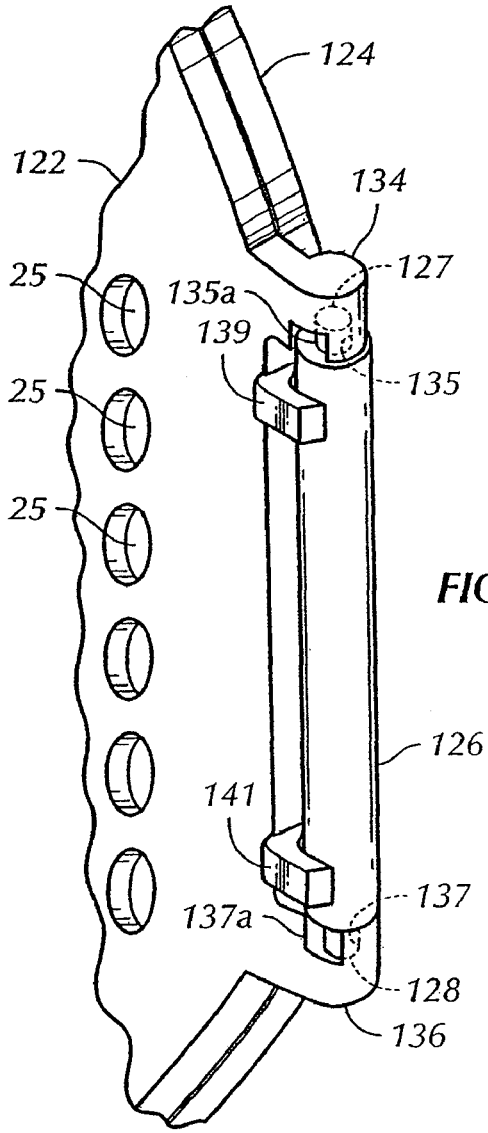
FIG. 12 is a detail perspective view showing an alternate hinge connection between alternate embodiments of plate members for the brassiere cleaning and storage container of the invention.

Referring briefly to FIGS. 11 and 12, alternate embodiments of the plate members are illustrated and generally designated by the numerals 122 and 124, respectively. Plate member 124 is also illustrated in FIG. 11 and is characterized by a hinge portion including an elongated somewhat cylindrical integral boss 126 having coaxially aligned and oppositely projecting hinge pins or trunnions 127 and 128 formed thereon. Plate member 124 also includes a modified brassiere cup support member 130 which is a single arcuate member fixed at one end 131 to plate member 124. Plate member 122 includes a similar cup support member, not shown. In most other respects, the plate members 122 and 124 are substantially like the plate members 22 and 24 except as noted herein.

Referring to FIG. 12, plate member 122 is formed with opposed spaced apart hinge pin receiving bosses 134 and 136 which are provided with, respectively, hinge pin receiving bores 135 and 137 having laterally projecting openings 135*a* and 137*a* formed therein, as shown. Plate 122 also includes spaced apart laterally offset projections 139 and 141 which are located on plate member 122 in such a way that the plate members may be aligned with each other while plate member 124 is moved relative to plate member 122 into a position such that the hinge pins 127 and 128 may be inserted in the pin receiving bores 135 and 137 through the lateral openings 135*a* and 137*a*, respectively. However, when the plate members 122 and 124 are rotated relative to each other in the normal usage of the brassiere holder or container in accordance with the invention, the projections 139 and 141 substantially prevent the plate members 122 and 124 from being disconnected. In essentially all other respects, a container or holder 20 utilizing the plate members 122 and 124 in place of the plate members 22 and 24 is the same as such container would be with use of the plate members 22 and 24.

The holder or container 20 may be formed entirely of molded plastic of a type which is durable and able to withstand the temperatures of clothing cleaning fluids, thus also being lightweight and corrosion resistant. Those skilled in the art will appreciate from the foregoing description that the container 20 advantageously supports a brassiere or similar garment for ease of cleaning, drying and storage while aiding greatly in retaining the shape of the garment and avoiding any damage thereto. Since the container 20 may be placed in conventional clothes washers and dryers, problems associated with washing brassiere-like garments without any supporting structure are eliminated.

Although a preferred embodiment of the invention has been described in detail herein, those skilled in the art will recognize that various substitutions and modifications may be made without departing from the scope and spirit of the appended claims.

What is claimed is:

1. A container for cleaning and storing brassieres, comprising:

a first substantially flat plate member;

a first brassiere cup support member disposed on the first substantially flat member;

a second substantially flat plate member hingedly connected to said first plate member;

a second brassiere cup support member disposed on the second substantially flat member;

a first container cup member hinged to said first plate member for movement between a position overlying said first plate member and a position to provide access to a brassiere supported by said container;

a second container cup member hinged to said second plate member for movement between a position overlying said second plate member and a position to provide access to said brassiere; and wherein said first brassiere cup support member and said second brassiere cup support members are skeletal.

2. The container set forth in claim 1 wherein:

said first brassiere cup support member and said second brassiere cup support members are cross-shaped.

3. The container set forth in claim 1 wherein:

said first brassiere cup support member and said second brassiere cup support members are a single bowed support structure.

4. The container set forth in claim 1 wherein:

said first brassiere cup support member and said second brassiere cup support members are arcuate and skeletal.

5. The container set forth in claim 1 wherein:

said first brassiere cup support member and said second brassiere cup support members are hingedly connected to said first substantially flat member and said second substantially flat member, respectively.

6. The container set forth in claim 2 wherein:

said first brassiere cup support member is hingedly connected on one end to said first substantially flat member and said second brassiere cup support member is hingedly connected on one end to said second substantially flat member.

7. The container set forth in claim 6 wherein:

said first substantially flat member and said second substantially flat member each comprise a hinge boss for pivotal movement of respective said hingedly attached first and said second brassiere cup support members.

8. A method of housing a brassiere for laundering, the method comprising:

rotating a first support cup member away from a first substantially flat member;

rotating a second support cup member away from a second substantially flat member;

placing a brassiere backstrap under a clip member disposed on the first substantially flat member;

placing the brassiere backstrap under a clip member disposed on the second substantially flat member;

rotating the first support cup member towards the first substantially flat member, supporting a first brassiere cup on the first substantially flat member;

rotating the second support cup member towards the second substantially flat member, supporting a second brassiere cup on the second substantially flat member;

latching said first substantially flat member and a first container cup member for releasably securing said first substantially flat member and said first container cup member to each other in a position to retain the first brassiere cup therebetween;

latching said second substantially flat member and a second container cup member for releasably securing said second substantially flat member and the second container cup member to each other in a position to retain the second brassiere cup member therebetween; and securing the first and second container cups and the first and second substantially flat members together to provide an enclosed housing which supports and covers the brassiere for laundering.

9. The container set forth in claim 1 further comprising a means for disconnectably coupling said first and second container cup members together.

* * * * *